United States Patent [19]

Jundt et al.

[11] Patent Number: 5,021,959

[45] Date of Patent: Jun. 4, 1991

[54] CONTROL DEVICE FOR INTERNAL COMBUSTION ENGINES

[75] Inventors: Werner Jundt, Ludwigsburg; Norbert Miller, Abstatt; Rainer Sommer, Ludwigsburg, all of Fed. Rep. of Germany

[73] Assignee: Robert Bosch GmbH, Stuttgart, Fed. Rep. of Germany

[21] Appl. No.: 391,539

[22] PCT Filed: Nov. 27, 1987

[86] PCT No.: PCT/EP87/00735

§ 371 Date: Jul. 26, 1989

§ 102(e) Date: Jul. 26, 1989

[87] PCT Pub. No.: WO89/04917

PCT Pub. Date: Jun. 1, 1989

[51] Int. Cl.[5] ..... F02D 41/06

[52] U.S. Cl. ..... 364/431.05; 123/489; 123/491

[58] Field of Search ..... 364/431.05, 431.01, 364/557; 123/489, 491; 73/119 A, 117.2

[56] References Cited

U.S. PATENT DOCUMENTS

| | | | |
|---|---|---|---|
| 4,357,922 | 11/1982 | Rosenzopf et al. | 123/489 |
| 4,484,554 | 11/1984 | Nakajima et al. | 123/340 |
| 4,677,559 | 6/1987 | van Brück | 364/431.05 |
| 4,723,523 | 2/1988 | Kataoka et al. | 123/491 |
| 4,739,741 | 4/1988 | Iwata et al. | 123/491 |

*Primary Examiner*—Gary Chin

*Attorney, Agent, or Firm*—Walter Ottesen

[57] ABSTRACT

In a control device (14) for fuel injection and/or spark ignition in an internal combustion engine, a first datablock (16) is programmed for operation in accordance with engine operating parameters (BM, P, L, n, T) but without lambda control when the engine is cold and a second datablock (18) is programmed for operation with lambda control when the engine is warm. A switching logic (26) switches in the first datablock (16) when the engine is started below a lower threshold ($T_1$) and switches over to the second datablock (18) when the temperature rises above a higher threshold ($T_2$).

3 Claims, 2 Drawing Sheets

CONTROL DEVICE FOR INTERNAL COMBUSTION ENGINES

FIELD OF THE INVENTION

The present invention relates to a control device for an internal combustion engine. The control device includes a computer which contains a first datablock for operation under one operating condition, a second datablock for operation under another operating condition and a processor for processing engine operating parameters in accordance with the data from the first or second datablock. The processor includes a switching device responsive to at least one operating parameter for selecting the datablock to be used.

BACKGROUND OF THE INVENTION

Such a control device is known from U.S. Pat. No. 4,398,520. This known control device controls fuel injection and spark ignition in a multi-cylinder internal combustion engine. A processor or computer includes two datablocks containing respective programs for two modes of operation and an arithmetic unit or central processing unit for controlling the injection and ignition in accordance with engine operating parameters and in accordance with a selected one of the programs. The arithmetic unit contains a switching logic or partial load recognition stage which switches from the first datablock to the second responsively to engine load. The switching logic also switches off some of the injection valves so that not all the cylinders produce power. The first and second datablocks are programmed for optimal performance in respective modes in which all cylinders are producing power or only some cylinders are producing power, the latter mode being used under low load.

This known control device, however, does not deal with the problem that it is often necessary or advantageous to operate in accordance with one program when the engine of cold and in accordance with another program when the engine is hot. In particular, it is desirable to be above to operate in a "lambda control" mode in order to minimize emission of noxious or toxic fumes in the exhaust, but this is not possible when the enigine is cold, i.e. when starting the engine.

DE-A- No. 32 33 791 describes a device for calling up and/or optimizing stored data which can be used for testing which of several stored programs, e.g, starting programs, is the best for a control device of an internal combustion engine. It is possible, using an input keyboard, to select different programs and to try out each program to check which is the best during an actual test run of the vehicle. However, there is no suggestion of a changeover from one program to another responsively to an engine operating parameter.

SUMMARY OF THE INVENTION

It is an object of the invention to provide a control device for an internal combustion engine which changes over from one control mode, which is used on starting with the engine cold, to another normal control mode (e.g. lambda control) which, however, is unsuitable for use with a cold engine.

This object is achieved by the control device according to the invention. According to a feature of the control device of the invention, the switching device of the processor is responsive to temperature, more particularly the cooling temperature (T), and switches over from the first datablock, which is programmed for operation under starting conditions, to the second datablock, which is programmed for normal operating conditions, when a predetermined temperature ($T_2$) is exceeded. This has the advantage that optimum performance of the engine in accordance with engine operating parameters can be obtained when the engine is cold and that optimum combustion conditions can be maintained by the use of lambda control as soon as the engine has warmed up.

The air number lambda is the actual air-to-fuel ratio divided by the stoichiometric air-to-fuel ratio. A measure of the air number lambda can be obtained by means of a lambda probe which is an oxygen sensor and is placed in the exhaust system so as to detect residual oxygen in the exhaust. It comprises a solid electrolyte which is only effective when hot. The output of the lambda probe is used to provide a feedback signal for the control device when operating in the lambda control mode. Lambda control implies a lean mixture whereas a rich mixture is required when the engine is cold. Thus the control device of the invention can operate without lambda control when the engine is cold and the lambda control is brought into use as soon as the engine has warmed sufficiently. The various engine operating parameters (intake vacuum, air intake quantity, engine speed, engine temperature) can be used as necessary and as appropriate to obtain optimum operation in each of the two modes.

If the engine is already warm on starting (e.g. upon re-starting before the engine has cooled), the lambda control mode can be brought in immediately upon starting so long as the engine temperature exceeds a lower threshold value by adopting the feature that the switching device switches to the first datablock when the engine is started with the sensed temperature below a lower predetermined temperature ($T_1$) and only switches to the second datablock when the sensed temperature exceeds the upper predetermined temperature ($T_2$), and the further feature that the switching device switches directly to the second datablock when the engine is started with the sensed temperature above the lower predetermined temperature ($T_1$).

BRIEF DESCRIPTION OF THE DRAWINGS

The invention is further described, by way of example, with reference to the accompanying drawings, in which.

DESCRIPTION OF THE PREFERRED EMBODIMENT OF THE INVENTION

Figure 1:
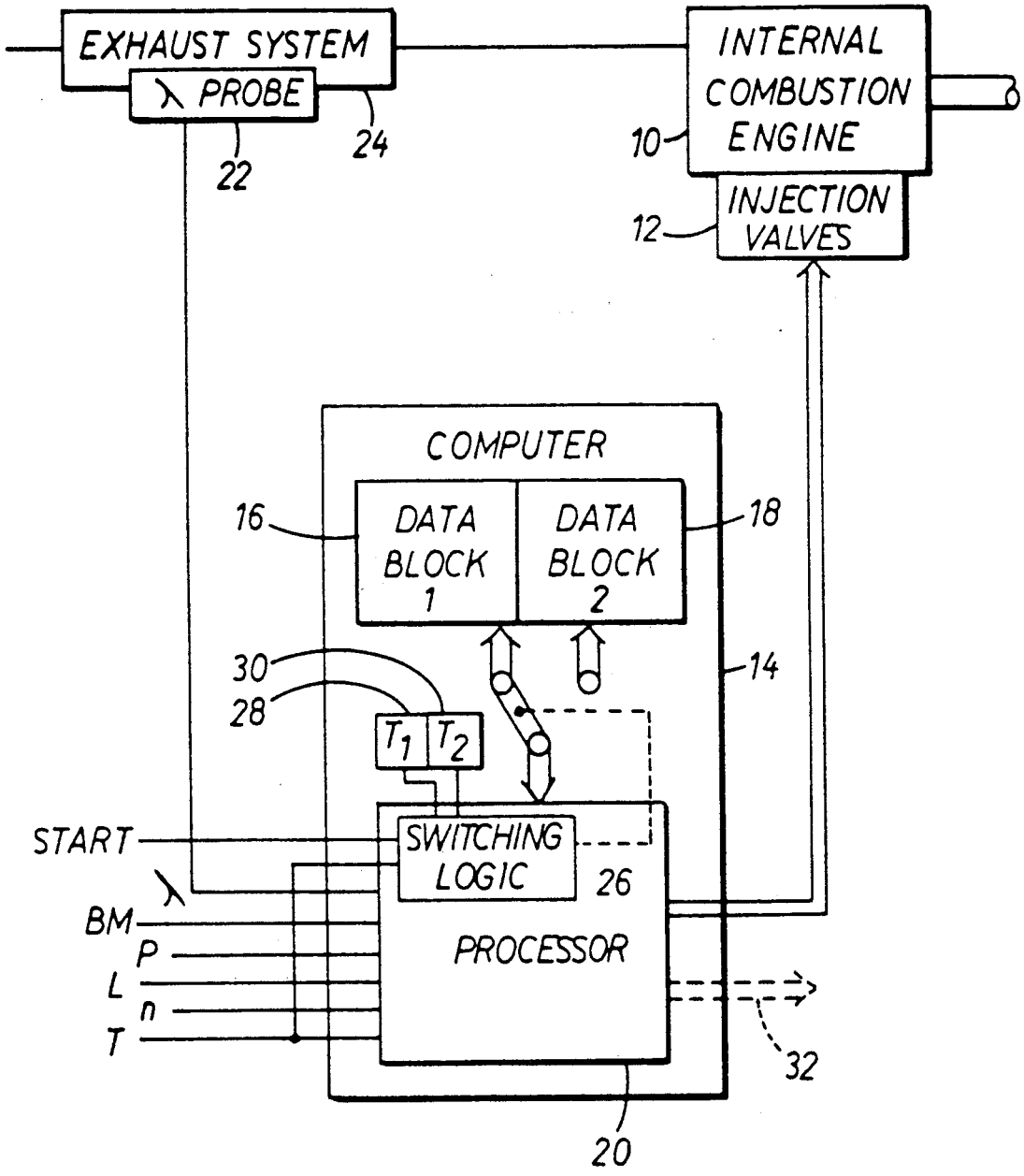
FIG. 1 is a block circuit diagram of a control device for an internal combustion engine in accordance with the invention.

FIG. 1 shows diagrammatically an internal combustion engine 10 operating with spark ignition and electronically controlled fuel injection. The latter includes injection valves 12 which may be of a kind opened intermittently synchronism with rotation of the engine crankshaft, the opening duration determining the injected fuel quantity, to of a kind held open continuously to an adjustable extent so that the fuel quantity is determined by the degree of throttling by the injection valves. The injection valves 12 are controlled by a computer 14, preferably a microprocessor. The computer 14 contains two datablocks 16, 18 in which are stored programs in accordance with which a processor 20 operates the injection valves 12 when the engine is cold and when it is hot, respectively. The processor 20 receives engine operating parameters which are processed in accordance with the selected program to determine the fuel quantity to be injected. These parameters include the air intake vacuum P, the air intake quantity (throttle flap position) L, the engine speed n and the engine coolant temperature T. They also include a reference mark BM drived from a pulse generator on the engine crankshaft and used for timing the injection operations and the air number λ derived from a lambda probe 22 in the exhaust system of the engine 24.

The processor 20 includes a switching logic 26 for determining which of the datablocks 16, 18 is selected. For this purpose, the switching logic receives the temperature signal T and signals from two reference temperature sources 28 and 30 may be incorporated in the computer 14. The switching logic 26 also receives a start signal indicative of when the engine 10 is being started. It may be derived from the starting switch for the starter motor.

Figure 2:
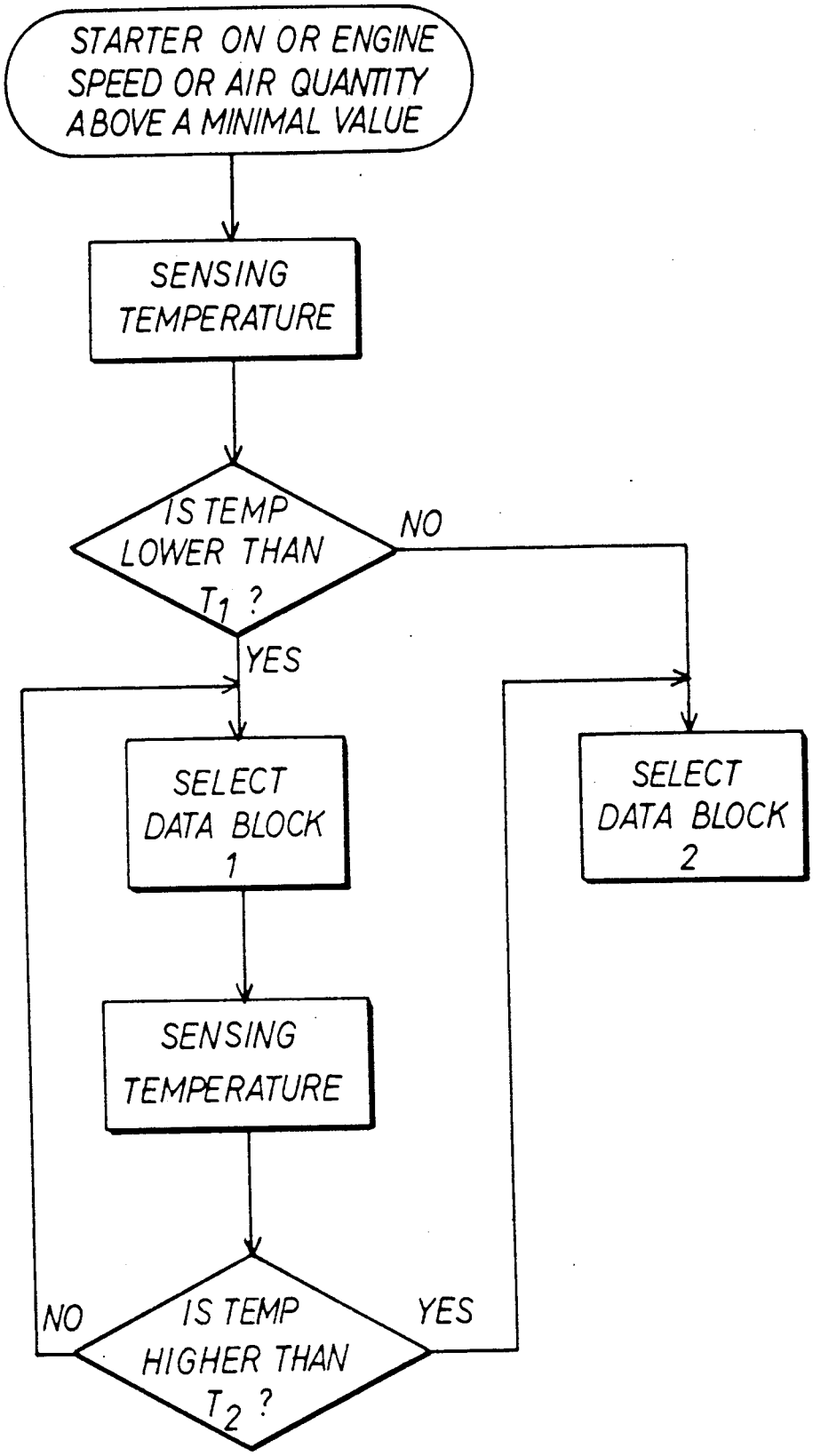
FIG. 2 is a flow diagram illustrating the operation of a switching logic in the control device.

The control device operates as follows:

when the ignition is switched on and the starter switch is operated, the switching logic 26 receives the start signal and the temperature signals T, $T_1$ and $T_2$. Referring now to FIG. 2, if the engine is cold the sensed temperature T is below a lower threshold $T_1$ set by the reference source 28, datablock 1 for operation under starting conditions is selected. The processor 20 controls the injection valves 12 without reference to the air number λ (lambda control switched off). As the engine warms up, the datablock 1 for operation under starting conditions remains in use until the sensed temperature T exceeds a second higher threshold $T_2$ determined by the reference source 30. The switching logic 26 then changes over from the first datablock 16 to the second datablock 18, as indicated diagrammatically in FIG. 1. The second datablock 18 stores the program for the processor 20 to operate the injection valves 12 with lambda control. Should the engine be started warm, in that the sensed temperature T already exceeds the lower threshold $T_1$ when the starter switch is operated, the switching logic immediately selects datablock 2 for operation with lambda control, as shown in FIG. 2.

As indicated by broken lines 32, the processor 20 may also operate the engine ignition system, the programs in the datablocks 16, 18 being adapted for this purpose.

What is claimed is:

1. A control device for an internal combustion engine, the control device comprising:

a computer including: a first datablock programmed for operating under starting conditions of the engine; a second datablock programmed for operating under normal operating conditions of the engine; and, a processor for processing engine operating parameters in accordance with data from said first or second datablock;

said processor including a switching device responsive to at least one operating parameter of the engine for selecting the one of said datablocks to be used;

said switching device being responsive to the temperature (T) of the cooling system for switching over from said first datablock to said second datablock when an upper predetermined temperature ($T_2$) is exceeded;

said switching device being adapted to switch to said first datablock when the engine is started with the sensed temperature below a lower predetermined temperature ($T_1$) determined separately from said upper predetermined temperature ($T_2$) and only switches to the second datablock when the sensed temperature exceeds the upper predetermined temperature ($T_2$); and, said switching device also being adapted to switch directly to the second datablock when the engine is started with the sensed temperature above said lower predetermined temperature ($T_1$).

2. The control device of claim 1, wherein the engine is a spark-ignition engine and said control device further comprises:

a lambda probe disposed in the exhaust system of the engine for measuring the residual oxygen content of the exhaust gases; and, said second datablock being programmed for lambda control wherein the fuel quantity fed to the engine is adjusted in response to the output of said lambda probe.

3. The control device of claim 2, wherein said first datablock is programmed to operate without said lambda control.

* * * * *

UNITED STATES PATENT AND TRADEMARK OFFICE

CERTIFICATE OF CORRECTION

PATENT NO. : 5,021,959

DATED : June 4, 1991

INVENTOR(S) : Werner Jundt, Norbert Miller and Rainer Sommer

It is certified that error appears in the above-identified patent and that said Letters Patent is hereby corrected as shown below:

In column 1, line 40: delete "of" and substitute -- is -- therefor.

In column 1, line 42: delete "above" and substitute -- able -- therefor.

In column 1, line 44: delete "enigine" and substitute -- engine -- therefor.

In column 2, line 57: delete "EMBODIMENT" and substitute -- EMBODIMENTS -- therefor.

In column 2, line 62, between "intermittently" and "synchronism", insert -- in --.

In column 2, line 64: delete "to" and substitute -- or -- therefor.

Signed and Sealed this

Eighteenth Day of May, 1993

*Attest:*

Michael K. Kirk

MICHAEL K. KIRK

*Attesting Officer*

*Acting Commissioner of Patents and Trademarks*